US012569068B2

(12) United States Patent
Chen et al.

(10) Patent No.: US 12,569,068 B2
(45) Date of Patent: Mar. 10, 2026

(54) SINGLE FOLDING SOFA BEDSTEAD

(71) Applicant: JIAXING REST FURNITURE & APPLIANCE CO., LTD., Jiaxing (CN)

(72) Inventors: Jiguan Chen, Jiaxing (CN); Bin Chen, Jiaxing (CN); Qiangqiang Wu, Jiaxing (CN); Baoli Zhang, Jiaxing (CN); Chong Ma, Jiaxing (CN)

(73) Assignee: JIAXING REST FURNITURE & APPLIANCE CO., LTD., Jiaxing (CN)

( * ) Notice: Subject to any disclaimer, the term of this patent is extended or adjusted under 35 U.S.C. 154(b) by 30 days.

(21) Appl. No.: 18/661,755

(22) Filed: May 13, 2024

(65) Prior Publication Data

US 2025/0089902 A1 Mar. 20, 2025

(30) Foreign Application Priority Data

Sep. 18, 2023 (CN) ..... 202311202283.3

(51) Int. Cl.
*A47C 17/17* (2006.01)
*A47C 17/165* (2006.01)
(Continued)

(52) U.S. Cl.
CPC ..... *A47C 17/17* (2013.01); *A47C 17/165* (2013.01); *A47C 19/122* (2013.01); *A47C 19/205* (2013.01)

(58) Field of Classification Search
CPC ..... A47C 17/225; A47C 17/14; A47C 17/165; A47C 17/28; A47C 19/024; A47C 19/122; A47C 17/17; A47C 19/205; A47C 17/2076; A47C 17/1756; A47C 17/13; A47C 17/86; A47C 17/23; A47C 20/041; A47C 19/045; A47C 17/20; A47C 20/08; A61G 7/015; A61G 7/0507; A61G 7/0514; A61G 7/053; A61G 7/16; A61G 7/012; A61G 7/002; A61G 7/005; A61G 7/018; A61G 7/05; A61G 7/008; A61G 7/052; A61G 7/0509; A61G 7/00
USPC ..... 5/13, 29, 618, 613, 2.1, 111, 86.1, 620, 5/614, 28, 18.1, 12.1, 81.1 R, 136, 604, 5/99.1, 37.1, 617, 611, 616, 600, 430
See application file for complete search history.

(56) References Cited

U.S. PATENT DOCUMENTS

2018/0064258 A1* 3/2018 Murphy ..... A47C 17/138
2022/0232986 A1* 7/2022 Chen ..... A47C 17/165

FOREIGN PATENT DOCUMENTS

CN 210018607 U * 2/2020
CN 112971432 B * 7/2023 ..... A47C 17/86

* cited by examiner

*Primary Examiner* — Madison Emanski
(74) *Attorney, Agent, or Firm* — Bayramoglu Law Offices

(57) ABSTRACT

A single folding sofa bedstead includes a bedstead frame body, a frame assembly, a first connecting rod assembly, a second connecting rod assembly, a first linkage rod group, and a second linkage rod group. The frame assembly has a first frame, a second frame, and a third frame. The first frame is pivotally connected to one side of the second frame, and the third frame is pivotally connected to the other side of the second frame. One end of the first connecting rod assembly is pivotally connected to the first frame, and the other end of the first connecting rod assembly is pivotally connected to the bedstead frame body. One end of the second connecting rod assembly is pivotally connected to the second frame, and the other end of the second connecting rod assembly is pivotally connected to the bedstead frame body.

9 Claims, 10 Drawing Sheets

(51) Int. Cl.
*A47C 19/12* (2006.01)
*A47C 19/20* (2006.01)

SINGLE FOLDING SOFA BEDSTEAD

CROSS REFERENCE TO THE RELATED APPLICATIONS

This application is based upon and claims priority to Chinese Patent Application No. 202311202283.3, filed on Sep. 18, 2023, the entire contents of which are incorporated herein by reference.

TECHNICAL FIELD

This application relates to a folding bed, and particularly relates to a single folding sofa bedstead.

BACKGROUND

Beds are one of essential household items in people's home life. However, beds usually occupy a large area and often occupy a very considerable living space. To improve the reasonable use area, people improve the use mode of the bed to obtain more space to move around. Therefore, the folding sofa bed industry emerges.

In the process of implementing this application, the applicant find that each folding structure of an existing folding sofa bed is an independent mechanism, and an operator needs to unfold the folding sofa bed in steps sequentially, resulting in a tedious unfolding process.

SUMMARY

An embodiment of this application provides a single folding sofa bedstead, which solves the problem that the existing folding sofa bed needs to be independently unfolded repeatedly.

To solve the above technical problem, this application is implemented as follows:

in a first aspect, a single folding sofa bedstead is provided, including a bedstead frame body, a frame assembly, a first connecting rod assembly, a second connecting rod assembly, a first linkage rod group, and a second linkage rod group. The frame assembly has a first frame, a second frame, and a third frame. The first frame is pivotally connected to one side of the second frame, and the third frame is pivotally connected to the other side of the second frame. When the first frame, the second frame, and the third frame are folded on the bedstead frame body, the third frame and the second frame are in a bent state, the third frame is located above the second frame, and the first frame is in a vertical state and is located on one side of the third frame and the second frame. One end of the first connecting rod assembly is pivotally connected to the first frame, and the other end of the first connecting rod assembly is pivotally connected to the bedstead frame body. One end of the second connecting rod assembly is pivotally connected to the second frame, and the other end of the second connecting rod assembly is pivotally connected to the bedstead frame body.

One end of the first linkage rod group is pivotally connected to the first connecting rod assembly, and the other end of the first linkage rod group is pivotally connected to the second connecting rod assembly. One end of the second linkage rod group is pivotally connected to the third frame, and the other end of the third connecting rod assembly is pivotally connected to one end of the second connecting rod assembly. The other side of the third frame is rotatably unfolded around a pivot point between the third frame and the second frame when the third frame is unfolded outwards from the bedstead frame body, the third frame drives the second frame to be unfolded through the second linkage rod group and the second connecting rod assembly, the second connecting rod assembly drives the first frame to be unfolded through the first linkage rod group and the first connecting rod assembly, and after the first frame, the second frame, and the third frame are completely unfolded, the first frame, the second frame, and the third frame form an overall bedstead.

In the embodiment of this application, the third frame drives the second frame to be unfolded through the second linkage rod group and the second connecting rod assembly. At the same time, the second frame drives the first frame to be unfolded through the second connecting rod assembly, the first linkage rod group, and the first connecting rod assembly. Thus, the single folding sofa bedstead is unfolded coherently at one time through interactions among the first connecting rod assembly, the second connecting rod assembly, the first linkage rod group, and the second linkage rod group. Moreover, in the unfolding process of this application, soft packets do not interfere with each other, so that a problem that the parts of the sofa bedstead are damaged due to misoperations of the operator to affect the function on other folding beds is unlikely to occur.

BRIEF DESCRIPTION OF THE DRAWINGS

The accompanying drawings described herein are used to provide a further understanding of this application, and form part of this application. Exemplary embodiments of this application and descriptions thereof are used to explain this application, and do not constitute any inappropriate limitation to this application. With the accompanying drawings, it is explained as follows.

Figure 1:
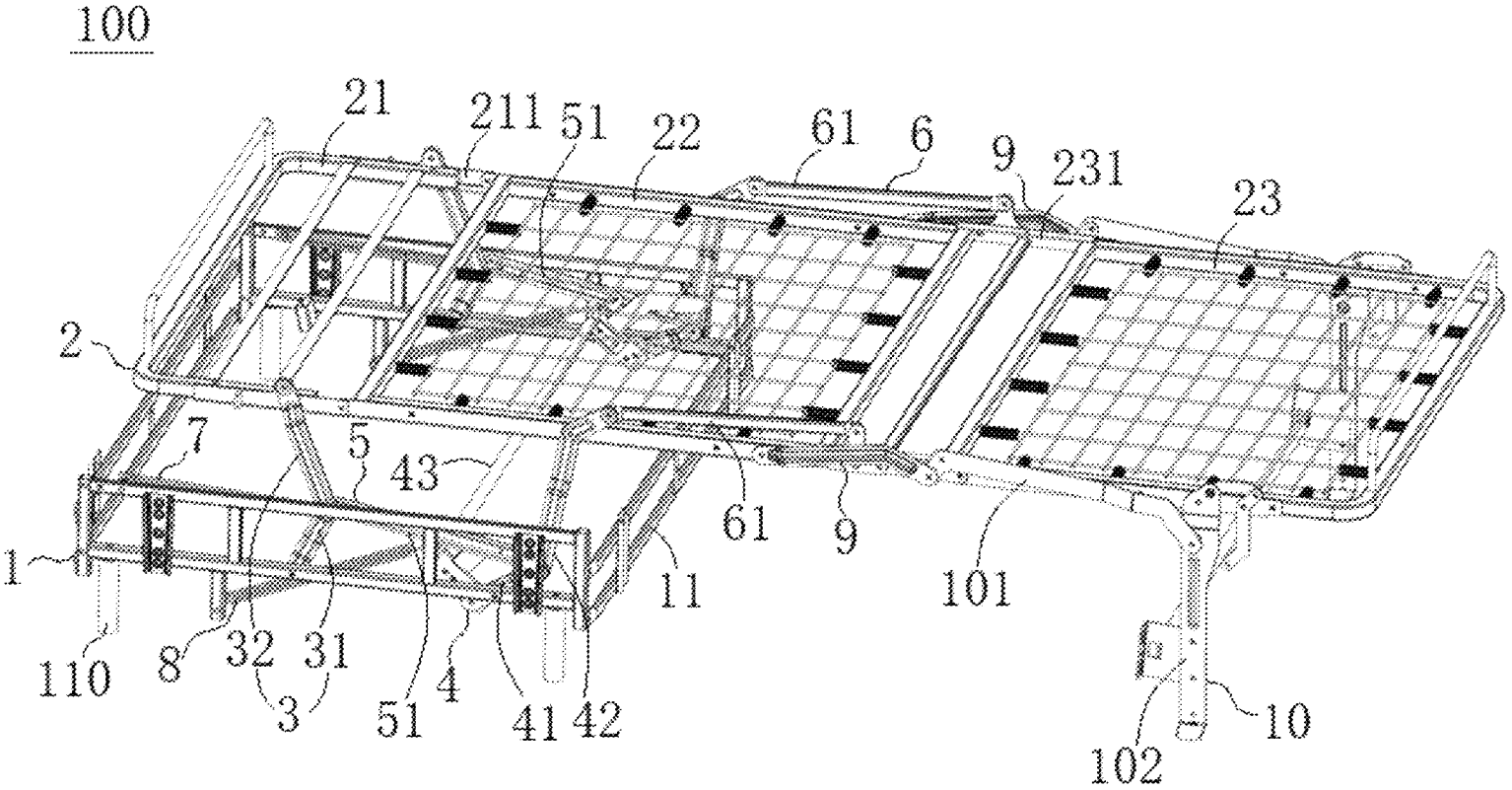
FIG. 1 is a stereogram of a single folding sofa bedstead in an embodiment of this application.

Reference numerals in the accompanying drawings:

100: single folding sofa bedstead; 1: a bedstead frame body; 11: rectangular frame; 12: foot pipe fixing sheet; 2: frame assembly; 21: first frame; 211: first angle steel; 22: second frame; 23: third frame; 231: third angle steel; 3: first connecting rod assembly; 31: first connecting rod; 32: second connecting rod; 4: second connecting rod assembly; 41: third connecting rod; 42: fourth connecting rod; 43: connection rod 5: first linkage rod group; 51: first linkage rod; 6: second linkage rod group; 61: second linkage rod; 7: first elastic assembly; 8: second elastic assembly; 9: reinforcing rod; 10: support assembly; 101: third linkage rod; 102: support member; 110: foot pipe assembly; 111: support pipe; 112: thread bushing; and 113: connection member.

DETAILED DESCRIPTION OF THE EMBODIMENTS

The technical solutions in embodiment of this application will be clearly and completely described below with reference to the accompanying drawings in the embodiment of this application. Apparently, the described embodiment is merely a part of, rather than, all of the embodiments of this application. All other embodiments obtained by a person of ordinary skill in the art based on the embodiments of this application without making creative efforts shall fall within the protection scope of this application.

In the description of this application, it should be understood that orientation or position relationships indicated by the terms such as "upper", "lower", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application.

In addition, the "first", "second" and the like used herein neither specifically indicate an order or an order of precedence nor limit this application, but are merely used to distinguish assemblies or operations described by same technical terms.

Referring to FIG. 1 to FIG. 6, FIG. 1 is a stereogram of a single folding sofa bedstead in an embodiment of this application, and FIG. 2 to FIG. 6 are schematic diagrams of an unfolding process of a single folding sofa bedstead in an embodiment of this application. As shown in the figures, the single folding sofa bedstead 100 includes a bedstead frame body 1, a frame assembly 2, a first connecting rod assembly 3, a second connecting rod assembly 4, a first linkage rod group 5, and a second linkage rod group 6. The bedstead frame body 1 is mainly configured to carry and accommodate the frame assembly 2. In this embodiment, the bedstead frame body 1 is a frame body formed by sequentially connecting four vertically arranged rectangular frames 11 end to end. The frame assembly 2 has a first frame 21, a second frame 22, and a third frame 23. The first frame 21 is pivotally connected to the second frame 22. In this embodiment, first angle steel 211 is arranged on a side of the first frame 21 adjacent to the second frame 22, and the second frame 22 is pivotally connected to the first frame 21 by a connecting shaft penetrating through the first angle steel 211. As shown in FIG. 1, a penetrating point of the connecting shaft is located at an end of the first angle steel 211 close to the second frame 22.

Figure 2:
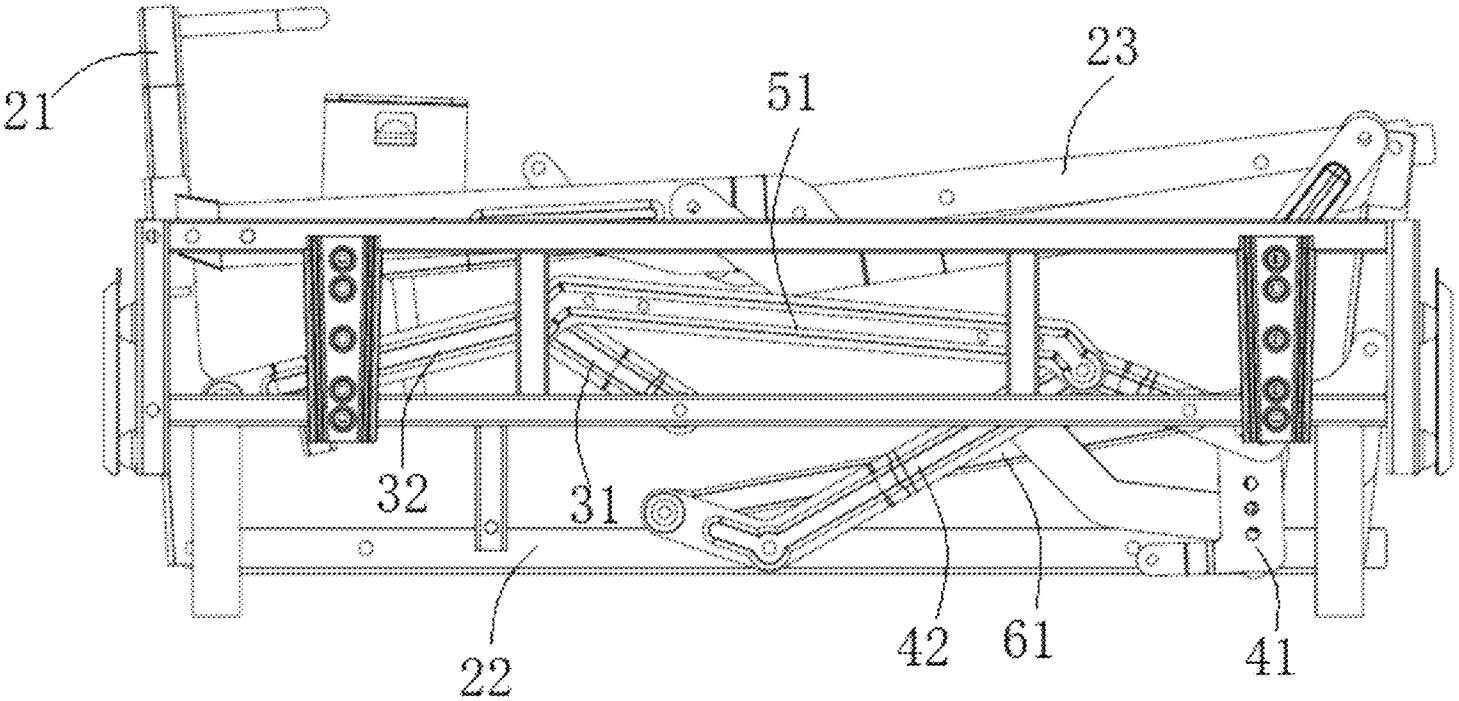
FIG. 2 to FIG. 6 are schematic diagrams of an unfolding process of a single folding sofa bedstead in an embodiment of this application.
Figure 3:
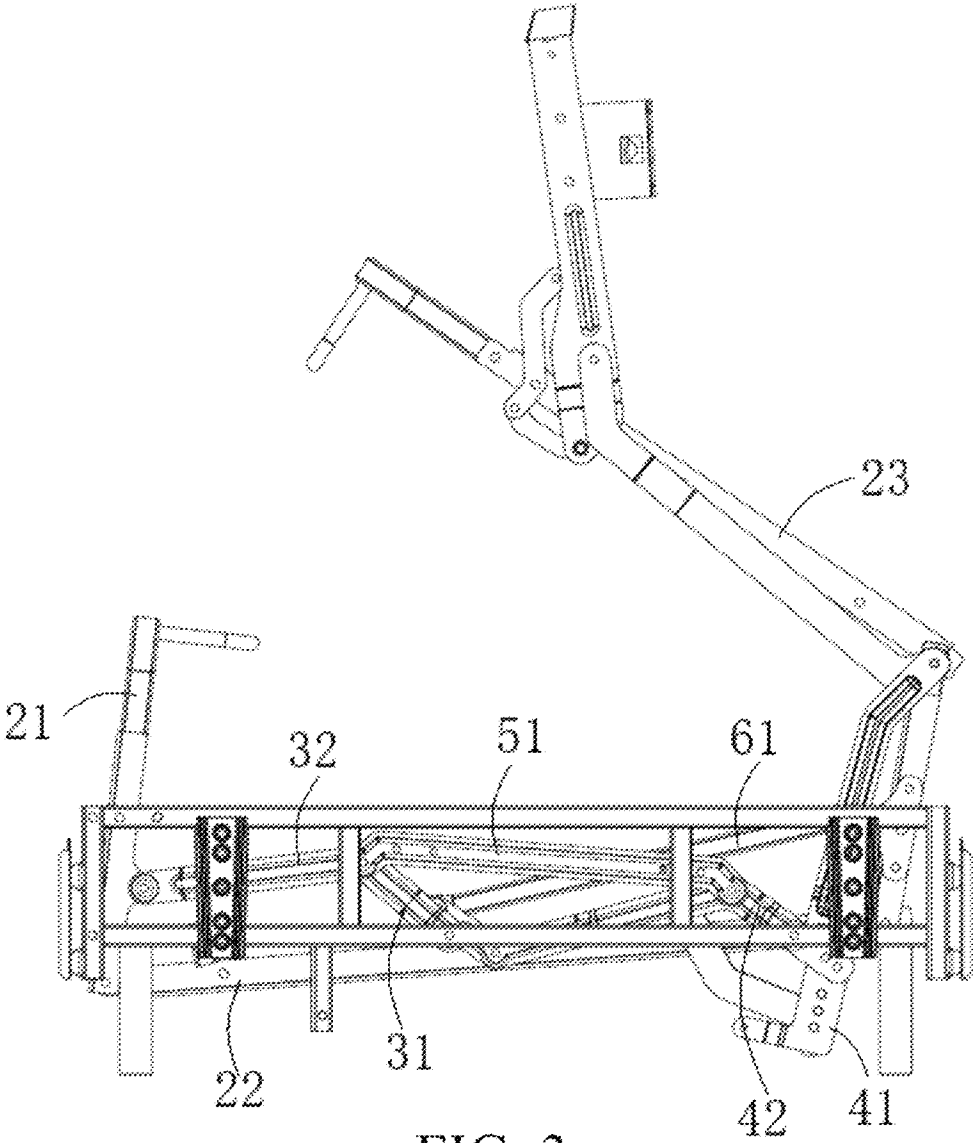
Figure 4:
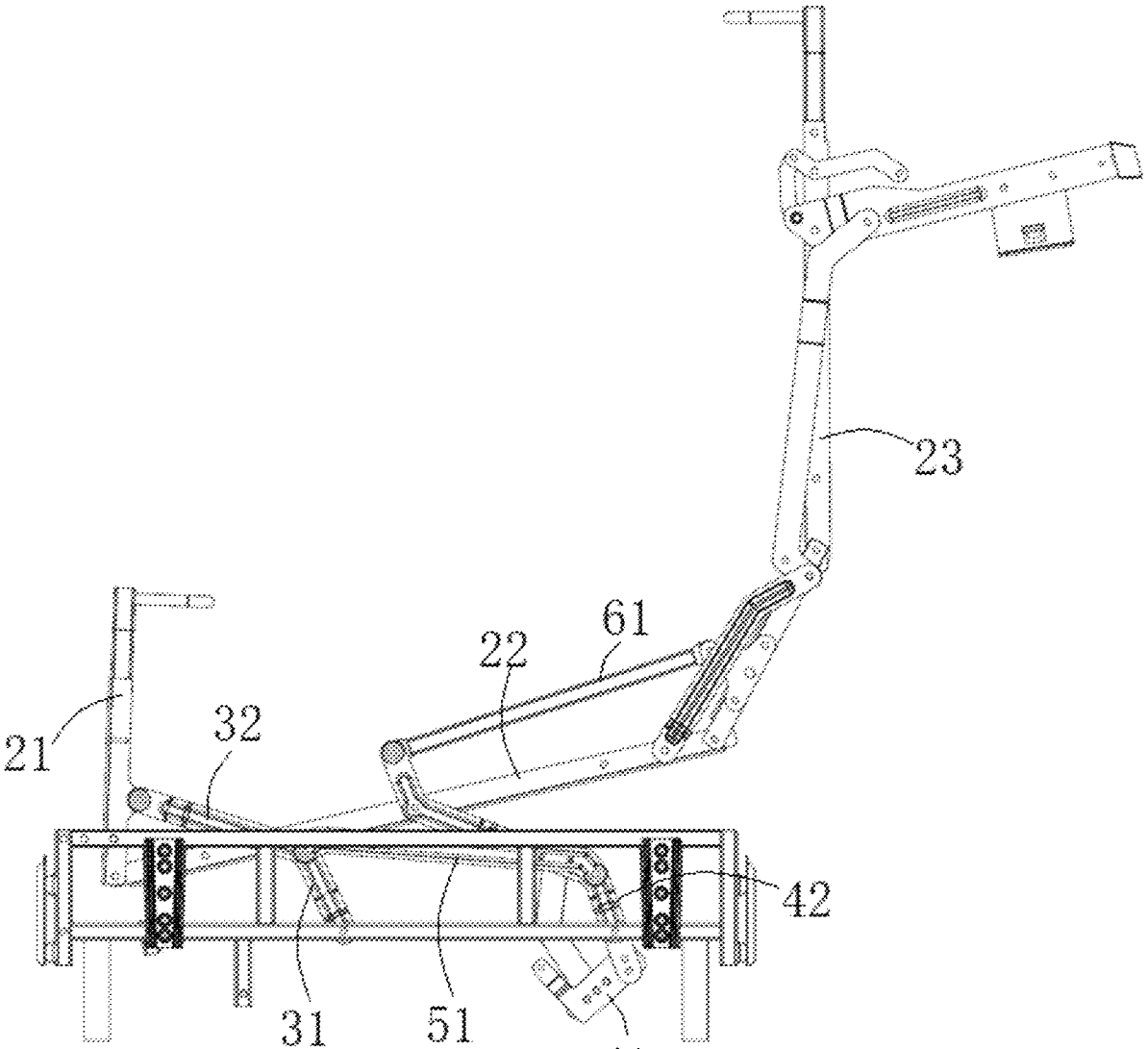
Figure 5:
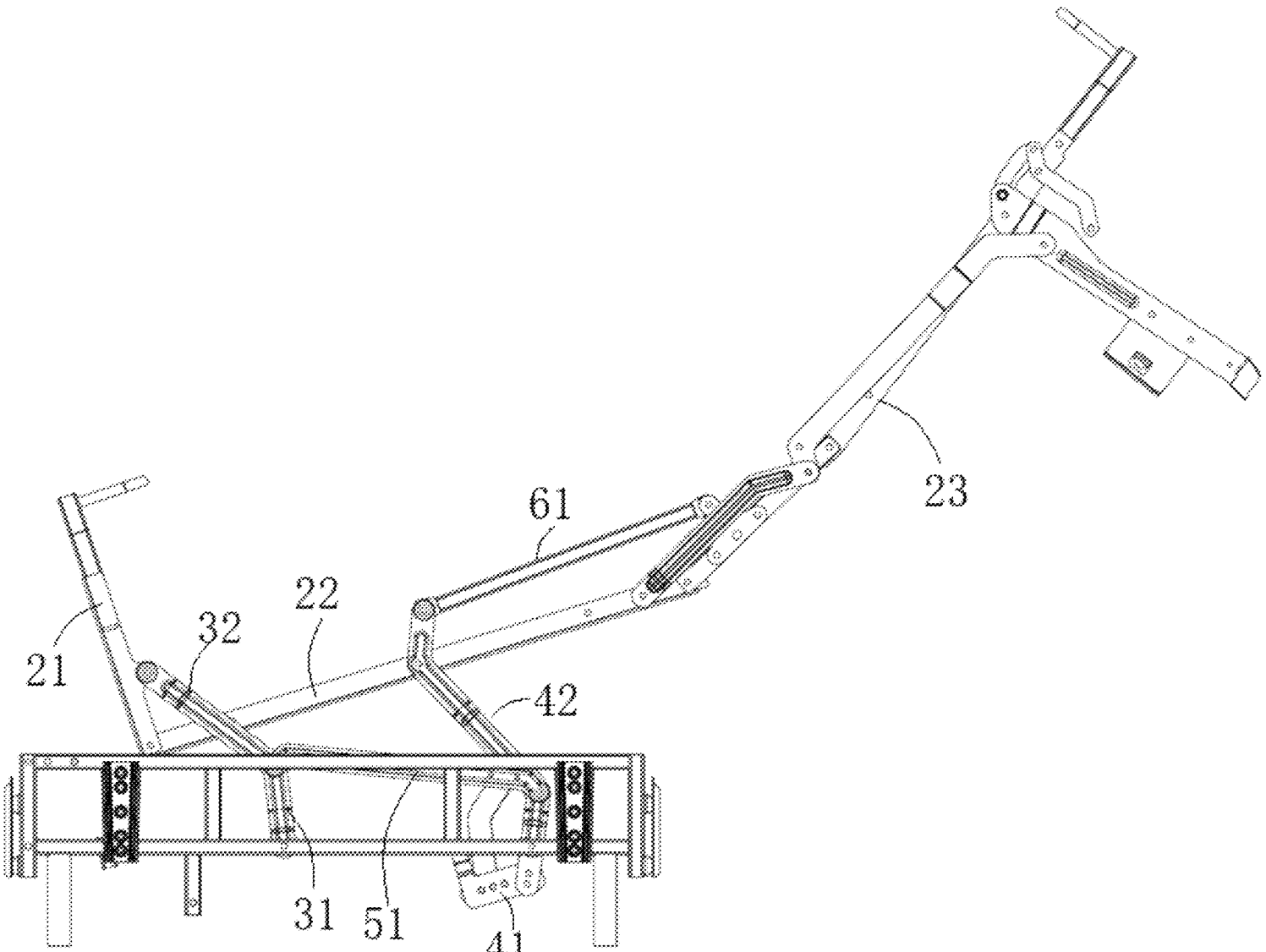
Figure 6:
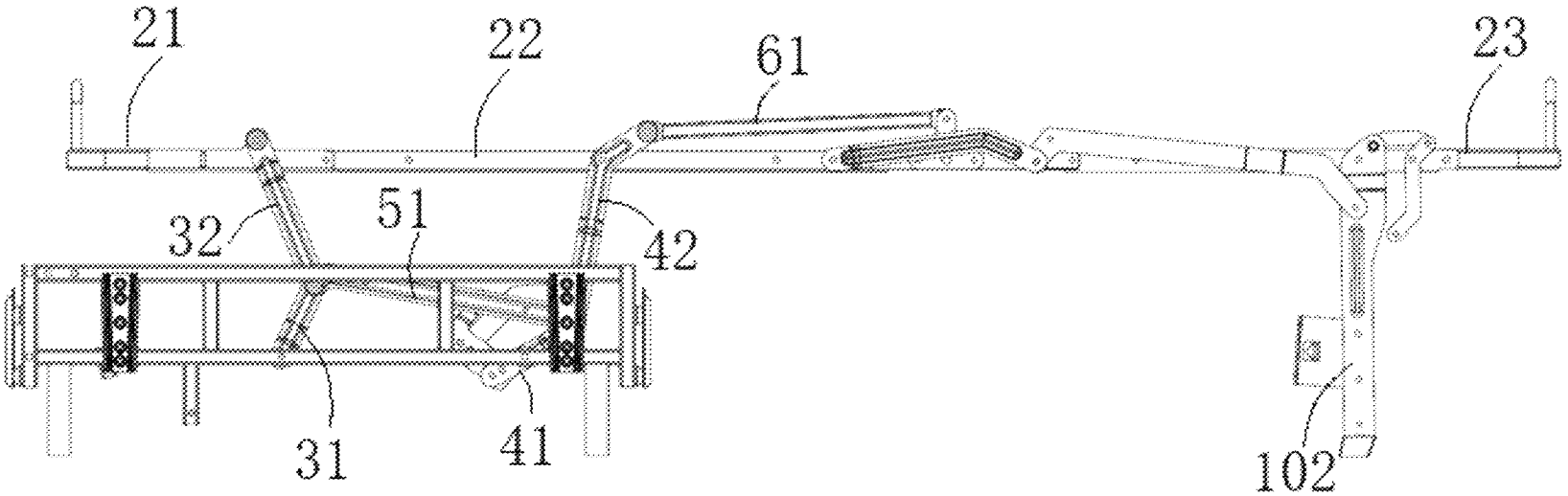

From the above, one side of the third frame 23 is pivotally connected to the other side of the second frame 22. In this embodiment, a second angle steel 231 is arranged on a side of the third frame 23 adjacent to the second frame 22, one side of the third frame 23 is pivotally connected to one end of the second angle steel 231, and the second frame 22 is pivoted to the third frame 23 by being pivotally connected to the other end of the second angle steel 231. When the first frame 21, the second frame 22, and the third frame 23 are folded on the bedstead frame body 1, the third frame 23 and the second frame 22 are in a bent state, the third frame 23 is located above the second frame 22, and the first frame 21 is in a vertical state and is located on one side of the third frame 23 and the second frame 22. As shown in FIG. 2, the first frame 21 is located on the left side of the third frame 23 and the second frame 22.

Referring to FIG. 1 again, one end of the first connecting rod assembly 3 is pivotally connected to the first frame 21, and the other end of the first connecting rod assembly 3 is pivotally connected to the bedstead frame body 1. In this embodiment, the first connecting rod assembly 3 includes two first connecting rods 31 and two second connecting rods 32. The two first connecting rods 31 and the two second connecting rods 32 are symmetrical on both sides of the bedstead frame body 1. As shown in FIG. 1, the two first connecting rods 31 and the two second connecting rods 32 are symmetrical on both sides of a width direction of the bedstead frame body 1. One end of each of the two first connecting rods 31 is pivotally connected to the bedstead frame body 1. As shown in FIG. 1, one end of each of the two first connecting rods 31 is pivotally connected to a lower end cross rod of each of the rectangular frames 11. The other end of each of the two first connecting rod 31 is pivotally connected to one end of each of the two second connecting rods 32. The other end of each of the two second connecting rods 32 is pivotally connected to the first frame 21. The first frame 21 is folded and unfolded on the bedstead frame body 1 through rotation of the two first connecting rods 31 and the two second connecting rods 32. Specifically, as shown in FIG. 2 to FIG. 6, the other end of each of the two first connecting rods 31 drives the first frame 21 to be unfolded on the bedstead frame body 1 when rotating (clockwise) toward an upper end around one end of the first connecting rod, so that the first frame 21 is in a horizontal state. Conversely, the other end of each of the two first connecting rods 31 drives the first frame 21 to be folded on the bedstead frame body 1 when rotating (anticlockwise) toward a lower end around one end of the first connecting rod, so that the first frame 21 is in a vertical state.

One end of the second connecting rod assembly 4 is pivotally connected to the second frame 22, and the other end of the second connecting rod assembly 4 is pivotally connected to the bedstead frame body 1. In this embodiment, the second connecting rod assembly 4 includes two third connecting rods 41, two fourth connecting rods 42, and a connection rod 43, where the two third connecting rods 41 and the two fourth connecting rods 42 are symmetrical on both sides of the bedstead frame body 1. The two third connecting rods 41 are pivotally connected to the bedstead frame body 1, and the two fourth connecting rods 42 are pivotally connected to the second frame 22. One end of each of the two third connecting rods 41 is pivotally connected to one end of each of the fourth connecting rods 42, and the other ends of the two third connecting rods 41 are connected to both ends of the connection rod 43. The second frame 22 is folded and unfolded on the bedstead frame body 1 through rotation of the two third connecting rods 41 and the two fourth connecting rods 42. Specifically, as shown in FIG. 2 to FIG. 6, the two third connecting rods 41 drive the first frame 21 to be unfolded on the bedstead frame body 1 when rotating clockwise. Conversely, the two third connecting rods 41 drive the first frame 21 to be folded on the bedstead frame body 1 when rotating anticlockwise.

One end of the first linkage rod group 5 is pivotally connected to the first connecting rod assembly 3, and the other end of the first linkage rod group 5 is pivotally connected to the second connecting rod assembly 4. In this embodiment, the first linkage rod group 5 includes two first linkage rods 51, one end of each of the two first linkage rods 51 is pivotally connected to a pivot point between each of the first connecting rods 31 and each of the second connecting rods 32, and the other end of each of the two first linkage rods 51 is pivotally connected to a pivot point between each of the third connecting rods 41 and each of the fourth connecting rods 42. The second frame 22 is unfolded on the bedstead frame body 1 through rotation of the two first connecting rods and the two second connecting rods 32 by the two linkage rods when the second frame 22 is unfolded on the bedstead frame body 1 through rotation of the two third connecting rods 41 and the two fourth connecting rods 42. Specifically, as shown in FIG. 2 to FIG. 6, when the two third connecting rods 41 rotate clockwise, the two third connecting rods 41 will drive the two first connecting rods 31 to rotate clockwise through the two fourth connecting rods 42 and the two first linkage rods 51. Conversely, when the two third connecting rods 41 rotate clockwise, the two third connecting rods 41 will drive the two first connecting rods 31 to rotate anticlockwise through the two first linkage rods 51.

One end of the second linkage rod group 6 is pivotally connected to the third frame 23, and the other end of the second linkage rod group 6 is pivotally connected to one end of the second connecting rod assembly 4. In this embodiment, the second linkage rod group 6 includes two second linkage rods 61, one end of each of the two second linkage rods 61 is pivotally connected to the other end of each of the two fourth connecting rods 42, and one end of each of the two second linkage rods 61 is pivotally connected to the third frame 23. The third frame 23 drives the second frame 22 to be unfolded on the bedstead frame body 1 through rotation of the two fourth connecting rods 42 driven by the two second linkage rods 61 when the third frame 23 is unfolded outwards from the bedstead frame body 1. Specifically, as shown in FIG. 2 to FIG. 6, the other side of the third frame 23 is rotatably unfolded around a pivot point between the third frame and the second frame 22, and the third frame 23 drives the two fourth connecting rods 42 to rotate clockwise through the two second linkage rods 61. Conversely, the other side of the third frame 23 is rotatably folded around the pivot point between the third frame and the second frame 22, and the third frame 23 drives the two fourth connecting rods 42 to rotate anticlockwise through the two second linkage rods 61.

Referring to FIG. 2 to FIG. 6 again, when the single folding sofa bedstead 100 in this embodiment is unfolded, the third frame 23 is manually turned, so that the other side of the third frame 23 is rotatably unfolded around the pivot point between the third frame and the second frame 22, the third frame 23 drives the second frame 22 to be unfolded through the second linkage rod group 6 and the second connecting rod assembly 4, the second connecting rod assembly 4 drives the first frame 21 to be unfolded through the first linkage rod group 5 and the first connecting rod assembly 3, and after the first frame 21, the second frame 22, and the third frame 23 are completely unfolded, the first frame 21, the second frame 22, and the third frame 23 form an overall bedstead. Thus, the single folding sofa bedstead 100 is unfolded coherently at one time through interactions among the first connecting rod assembly 3, the second connecting rod assembly 4, the first linkage rod group 5, and the second linkage rod group 6. Moreover, in the unfolding process of the single folding sofa bedstead 100 in this embodiment, soft packets do not interfere with each other, so that a problem that the parts of the sofa bedstead are damaged due to misoperations of the operator to affect the function on other folding beds is unlikely to occur.

Referring to FIG. 1 again, the single folding sofa bedstead 100 further includes a first elastic assembly 7 and a second elastic assembly 8. One end of the first elastic assembly 7 is connected to a side of the bedstead frame body 1 close to the first frame 21, and the other end of the first elastic assembly 7 is connected to a pivot point between each of the first connecting rods and each of the second connecting rods 32. One end of the second elastic assembly 8 is connected to a lower end of the first bedstead frame body 1 and the other end of the second elastic assembly 8 is connected to the other ends of each of the first connecting rods and each of the third connecting rods 41. When the single folding sofa bedstead 100 is in the unfolded state, the first elastic assembly 7 and the second elastic assembly 8 are both in the elastic sate to provide extra assistance to the single folding sofa bedstead 100 when being folded, so as to guarantee the lightness and convenience of the single folding sofa bedstead 100 in the using process, thereby reducing the burden of a user. In this embodiment, the first elastic assembly 7 uses two first springs, and the second elastic assembly 8 uses two second springs.

Figure 7:
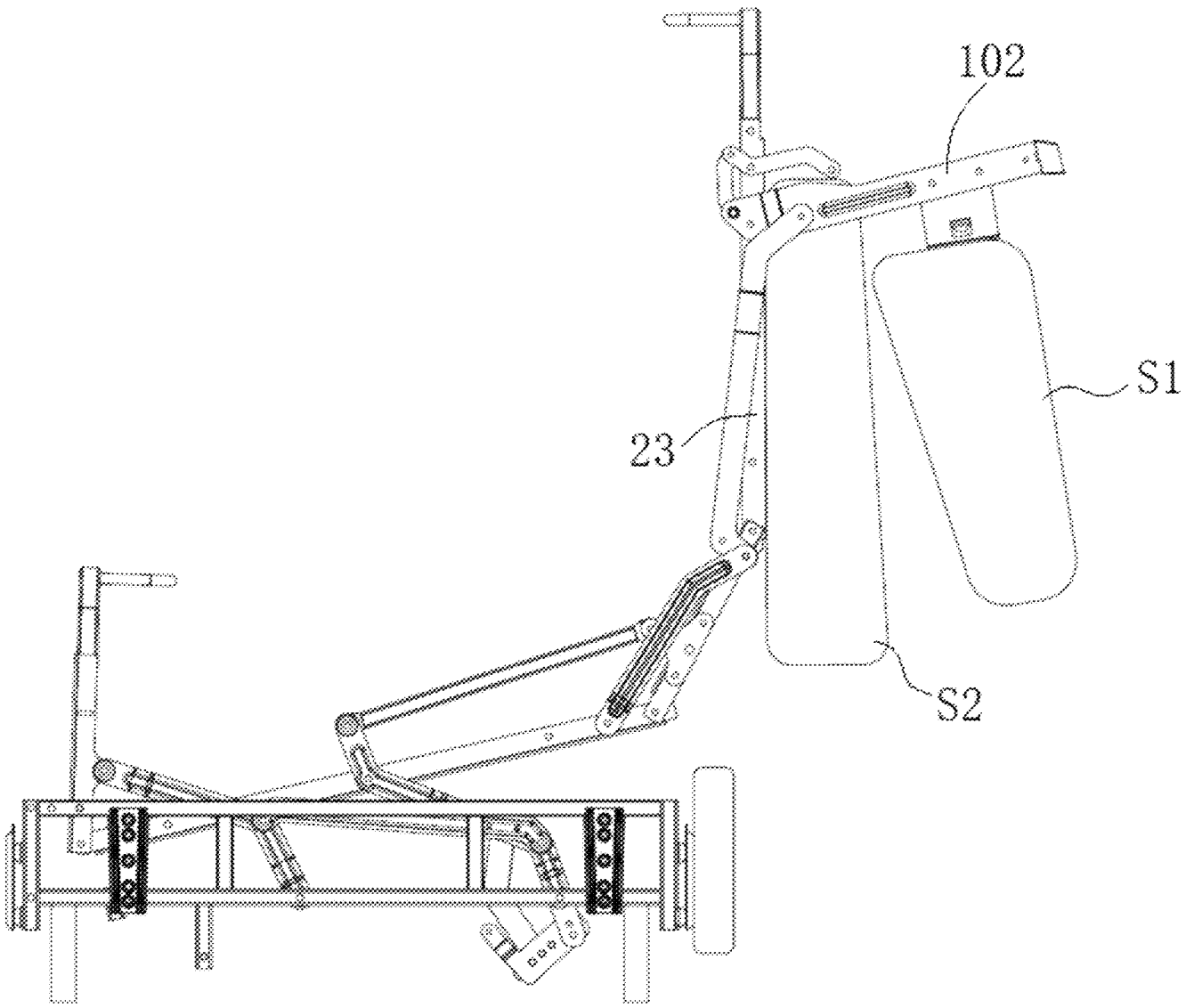
FIG. 7 is a side view of a novel sofa bed in an embodiment of this application.

Referring to FIG. 1 and FIG. 6 again, the single folding sofa bedstead 100 further includes two support assemblies 10, and the two support assemblies 10 are connected to the third frame 23. Each of the support assemblies 10 includes a third linkage rod 101 and a support member 102. One end of the third linkage rod 101 is pivotally connected to a pivot point between a reinforcing rod 9 and the second angle steel 231, and the other end of the third linkage rod 101 is pivotally connected to the support member 102. One end of the support member 102 is pivotally connected to an extension frame. When the third frame 23 is unfolded, the other end of the support member 102 abuts against the ground to support the extension frame. Referring to FIG. 7 together, FIG. 7 is a side view of a novel sofa bed in folding sofa bedstead in an embodiment of this application. As shown in the figure, in the single folding sofa bedstead 100 in this embodiment, a backrest S1 in the soft packet of the sofa can be integrated to the support member 102, a cushion S2 is integrated to a side of the third frame 23 adjacent to the support member 102, and after the single folding sofa bedstead 100 is unfolded, the backrest S1 and the cushion S2 are turned below the overall bedstead.

Figure 8:
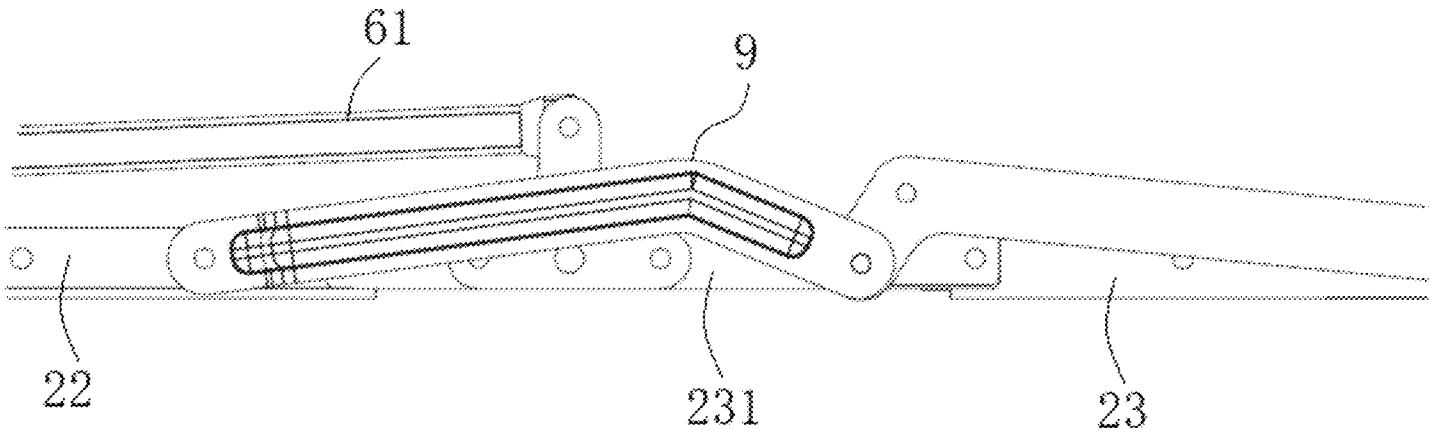
FIG. 8 is a partial schematic diagram of a single folding sofa bedstead in an embodiment of this application.

Referring to FIG. 8 together, FIG. 8 is a partial schematic diagram of a single folding sofa bedstead in an embodiment of this application. As shown in the figure, the single folding sofa bedstead 100 further includes two reinforcing rods 9, and the two reinforcing rods 9 are symmetrical on both sides of the bedstead frame body 1. Each of the reinforcing rods 9 is in a bent state. One end of each of the reinforcing rods 9 is pivotally connected to a side of the second frame 22 close to the second angle steel 231, and the other end of the reinforcing rods 9 is pivotally connected to a side of the second angle steel 231 close to the third frame 23. As shown in FIG. 1, when the single folding sofa bedstead 100 is unfolded, a bending point of each of the reinforcing rods 9 is located above the second angle steel 231. When the user lies on the single folding sofa bedstead 100, the center-of-gravity position of the user is located in a middle section of the overall bedstead. By arranging the reinforcing rods 9 between the second frame 22 and the third frame 23, it can be guaranteed that the gravity of the user is fully borne without a middle support foot, and the middle section of the bedstead does not collapse, so that the use comfort level is improved.

Figure 9:
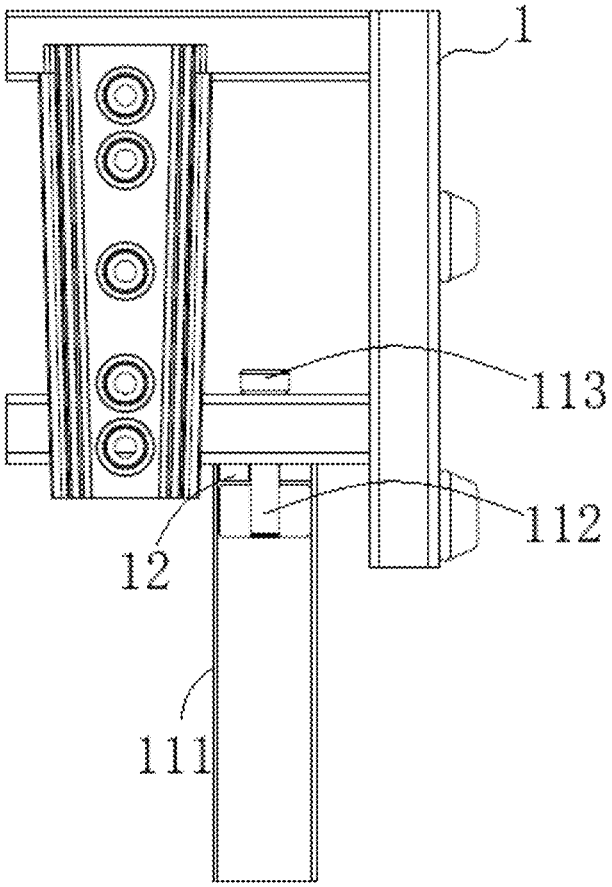
FIG. 9 is a schematic diagram of a plurality of foot pipe assemblies of a single folding sofa bedstead in an embodiment of this application.

Referring to FIG. 9 and FIG. 1 together, FIG. 9 is a schematic diagram of a plurality of foot pipe assemblies of a single folding sofa bedstead in an embodiment of this application. As shown in the figures, the single folding sofa bedstead 100 further includes a plurality of foot pipe assemblies 110, and the plurality of foot pipe assemblies 110 are arranged at the lower end of the bedstead frame body 1 for supporting the bedstead frame body 1. Each of the foot pipe assemblies 110 includes a support pipe 111, a thread bushing 112, and a connection member 113, where the thread bushing 112 is in threaded connection to an upper end of the support pipe 111, a foot pipe fixing sheet 12 is arranged at the lower end of the bedstead frame body 1, the support pipe 111 corresponds to the foot pipe fixing sheet 12 and is vertically arranged at the lower end of the bedstead frame body 1, and one end of the connection member 113 passes through the bedstead frame body 1 and the foot pipe fixing sheet 12 in sequence to be connected to the thread bushing 112. Thus, the stable anti-loosening performance of the support pipe 111 can be enhanced, so that the stability of the support pipe 111 in a sofa dragging process is improved. A bolt is used in the connection member 113.

Figure 10:
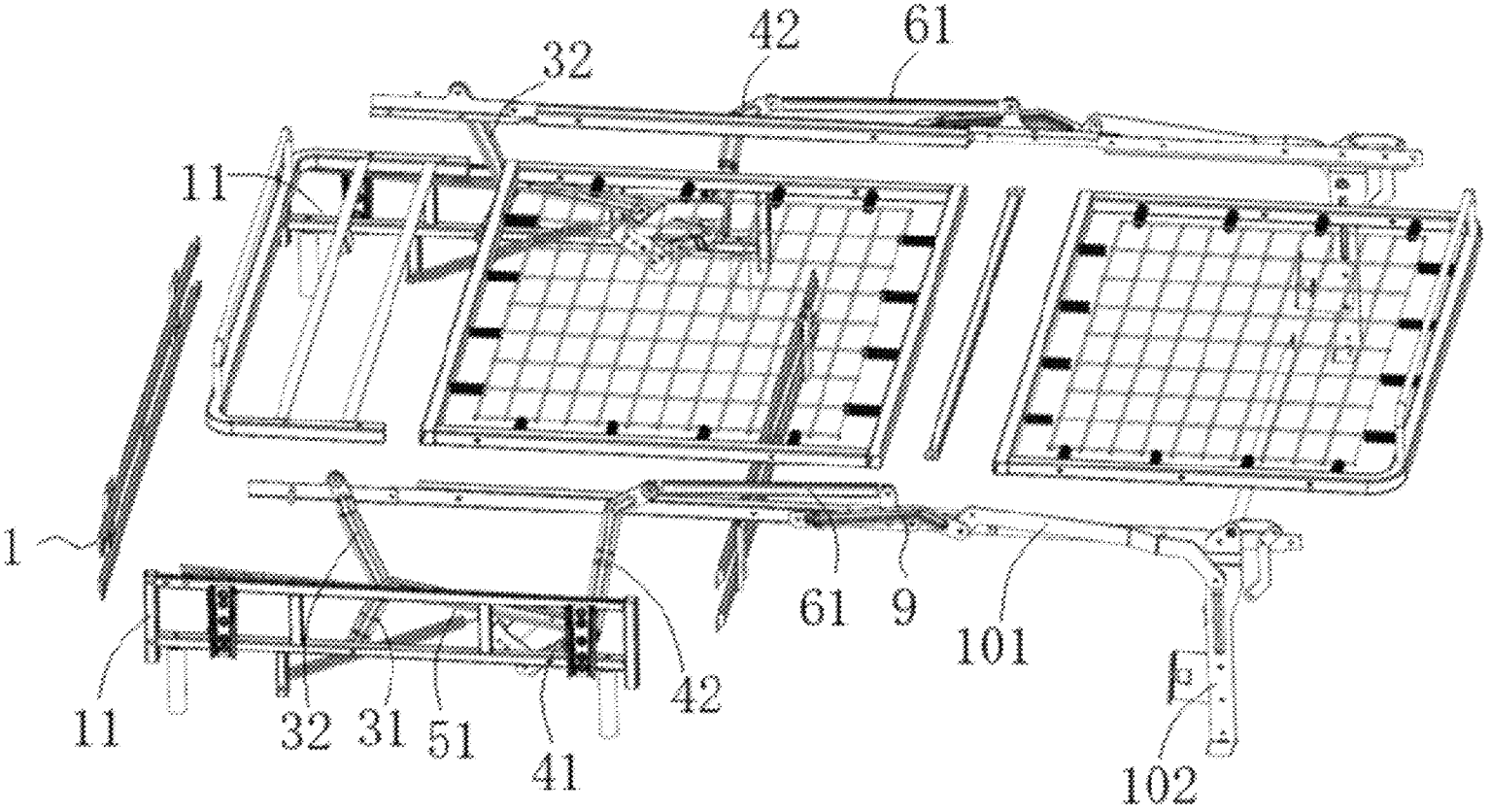
FIG. 10 is an exploded view of a single folding sofa bedstead in an embodiment of this application.

Referring to FIG. 10 and FIG. 1 together, FIG. 10 is an exploded view of a single folding sofa bedstead in an embodiment of this application. As shown in the figure, the partial frame assembly 2 (frame rods on both sides of the first frame 21, the second frame 22, and the third frame 23), the partial bedstead frame body 1 (the rectangular frames 11), the first connecting rods 31, the second connecting rods 32, the first linkage rods 51, the third connecting rods 41, the fourth connecting rods 42, and the second linkage rods 61 on each side of the bedstead frame body 1 form an independently connected unit. Thus, modular production is realized. The single folding sofa bedstead has the following advantages: 1. The units are assembled and fixed with a small amount of screws, and clients or consumers can assemble the single folding sofa bedstead by themselves in the simplest manner; 2. All points of rotation are realized by riveting sheet metal planes, compared with riveting between sheet metal parts and pipe fittings, the precision of hole sites, the strength and wear resistance, and the riveting efficiency are greatly improved; 3. Products are stored and transported and parts are maintained and replaced more favorably due to a modular assembly design. In this embodiment, the reinforcing rod 9, the third linkage rod 101 and the support member 102 are further connected in sequence on the right side of the independent unit.

In conclusion, this application provides a single folding sofa bedstead. In this application, the third frame drives the second frame to be unfolded through the second linkage rod group and the second connecting rod assembly. At the same time, the second frame drives the first frame to be unfolded through the second connecting rod assembly, the first linkage rod group, and the first connecting rod assembly. Thus, the single folding sofa bedstead is unfolded coherently at one time through interactions among the first connecting rod assembly, the second connecting rod assembly, the first linkage rod group, and the second linkage rod group. Moreover, in the unfolding process of this application, soft packets do not interfere with each other, so that a problem that the parts of the sofa bedstead are damaged due to misoperations of the operator to affect the function on other folding beds is unlikely to occur.

It should be noted that the terms "include", "comprise", or any other variation thereof in this specification is intended to cover a non-exclusive inclusion, which specifies the presence of stated processes, methods, objects, or apparatuses, but do not preclude the presence or addition of one or more other processes, methods, objects, or apparatuses. Without more limitations, elements defined by the sentence "including one" does not exclude that there are still other same elements in the processes, methods, objects, or apparatuses.

The embodiment of this application has been described above with reference to the accompanying drawings. This application is not limited to the specific embodiments described above, and the specific embodiments described above are merely exemplary rather than restrictive. Those of ordinary skill in the art may make various variations under the teaching of this application without departing from the spirit of this application and the protection scope of the claims, and such variations shall all fall within the protection scope of this application.

What is claimed is:

1. A single folding sofa bedstead, comprising:

a bedstead frame body;

a frame assembly, having a first frame, a second frame, and a third frame, wherein the first frame is pivotally connected to a first side of the second frame, and a first side of the third frame is pivotally connected to a second side of the second frame; when the first frame, the second frame, and the third frame are folded on the bedstead frame body, the third frame and the second frame are in a bent state, the third frame is located above the second frame, and the first frame is in a vertical state and is located on a second side of the third frame and the first side of the second frame;

a first connecting rod assembly, wherein a first end of the first connecting rod assembly is pivotally connected to the first frame, and a second end of the first connecting rod assembly is pivotally connected to the bedstead frame body;

a second connecting rod assembly, wherein a first end of the second connecting rod assembly is pivotally connected to the second frame, and a second end of the second connecting rod assembly is pivotally connected to the bedstead frame body;

a first linkage rod group, wherein a first end of the first linkage rod group is pivotally connected to the first connecting rod assembly, and a second end of the first linkage rod group is pivotally connected to the second connecting rod assembly; and a second linkage rod group, wherein a first end of the second linkage rod group is pivotally connected to the third frame, and a second end of the second linkage rod group is pivotally connected to the first end of the second connecting rod assembly;

wherein the second side of the third frame is rotatably unfolded around a pivot point between the third frame and the second frame when the third frame is unfolded outwards from the bedstead frame body, the third frame drives the second frame to be unfolded through the second linkage rod group and the second connecting rod assembly, the second connecting rod assembly drives the first frame to be unfolded through the first linkage rod group and the first connecting rod assembly, and after the first frame, the second frame, and the third frame are completely unfolded, the first frame, the second frame, and the third frame form an overall bedstead;

wherein the first connecting rod assembly comprises two first connecting rods and two second connecting rods, wherein the two first connecting rods are symmetrical on both sides of the bedstead frame body, the two second connecting rods are symmetrical on both sides of the bedstead frame body, a first end of each of the two first connecting rods is pivotally connected to the bedstead frame body, a second end of each of the two first connecting rods is pivotally connected to a first end of each of the two second connecting rods, a second end of each of the two second connecting rods is pivotally connected to the first frame, and the first frame is folded and unfolded on the bedstead frame body through rotation of the two first connecting rods and the two second connecting rods.

2. The single folding sofa bedstead according to claim 1, wherein the second connecting rod assembly comprises two third connecting rods, two fourth connecting rods, and a connection rod, wherein the two third connecting rods are symmetrical on both sides of the bedstead frame body, the two fourth connecting rods are symmetrical on both sides of the bedstead frame body, the two third connecting rods are pivotally connected to the bedstead frame body, the two fourth connecting rods are pivotally connected to the second frame, a first end of each of the two third connecting rods is pivotally connected to a first end of each of the two fourth connecting rods, second ends of the two third connecting rods are connected to both ends of the connection rod, and the second frame is folded and unfolded on the bedstead frame body through rotation of the two third connecting rods and the two fourth connecting rods.

3. The single folding sofa bedstead according to claim 2, wherein the first linkage rod group comprises two first linkage rods, wherein a first end of each of the two first linkage rods is pivotally connected to a pivot point of each of the first connecting rod and the second connecting rod, and a second end of each of the two first linkage rods is pivotally connected to a pivot point of each of the third connecting rod and the fourth connecting rod, wherein the second frame drives the two first connecting rods and the two second connecting rods to rotate to be unfolded on the bedstead frame body through the two first linkage rods when the second frame is unfolded on the bedstead frame body through rotation of the two third connecting rods and the two fourth connecting rods.

4. The single folding sofa bedstead according to claim 3, wherein the second linkage rod group comprises two second linkage rods, wherein a first end of each of the two second linkage rods is pivotally connected to a second end of each of the two fourth connecting rods, and a second end of each of the two second linkage rods is pivotally connected to the third frame, wherein the third frame drives the second frame to be unfolded on the bedstead frame body through rotation of the two fourth connecting rods driven by the two second linkage rods when the third frame is unfolded outwards from the bedstead frame body.

5. The single folding sofa bedstead according to claim 4, wherein the partial frame assembly, the partial bedstead frame body, the first connecting rod, the second connecting rod, the first linkage rod, the third connecting rod, the fourth connecting rod, and the second linkage rod on each side of the bedstead frame body form an independently connected unit.

6. The single folding sofa bedstead according to claim 2, further comprising:

a first elastic assembly, wherein a first end of the first elastic assembly is connected to a side of the bedstead frame body adjacent to the first frame, and a second end of the first elastic assembly is connected to a pivot point between the first connecting rod and the second connecting rod; and a second elastic assembly, wherein a first end of the second elastic assembly is connected to a lower end of the bedstead frame body, and a second end of the second elastic assembly is connected to the other end of each of the first connecting rod and the third connecting rod;

wherein the first elastic assembly and the second elastic assembly are both in an elastic state when the single folding sofa bedstead is in an unfolded state.

7. The single folding sofa bedstead according to claim 1, wherein a steel angle is arranged on the first side of the third frame adjacent to the second frame, the first side of the third frame is pivotally connected to a first end of the steel angle, and the second frame is pivotally connected to the third frame by being pivotally connected to a second end of the steel angle.

8. The single folding sofa bedstead according to claim 7, further comprising: two reinforcing rods, symmetrical on both sides of the bedstead frame body, wherein each of the two reinforcing rods is in a bent state, a first end of each of the two reinforcing rods is pivotally connected to the second side of the second frame adjacent to the steel angle, and a second end of each of the two reinforcing rods is pivotally connected to a side of the steel angle adjacent to the third frame; and two support assemblies, connected to the third frame, wherein each of the two support assemblies comprises a third linkage rod and a support member, a first end of the third linkage rod is pivotally connected to a pivot point between one reinforcing rod of the two reinforcing rods and the steel angle, a second end of the third linkage rod is pivotally connected to the support member, a first end of the support member is pivotally connected to the third frame, and when the third frame is unfolded, a second end of the support member abuts against a ground to support the third frame.

9. The single folding sofa bedstead according to claim 1, further comprising: a plurality of foot pipe assemblies, arranged at the lower end of the bedstead frame body, wherein each of the plurality of foot pipe assemblies comprises a support pipe, a thread bushing, and a connection member, the thread bushing is in threaded connection to an upper end of the support pipe, a foot pipe fixing sheet is arranged at a lower end of the bedstead frame body, the support pipe corresponds to the foot pipe fixing sheet and is vertically arranged at the lower end of the bedstead frame body, and an end of the connection member passes through the bedstead frame body and the foot pipe fixing sheet in sequence to be connected to the thread bushing.

* * * * *